US006988940B1

(12) United States Patent
Taylor

(10) Patent No.: US 6,988,940 B1
(45) Date of Patent: Jan. 24, 2006

(54) DUSTLESS SANDER

(76) Inventor: Bruce Taylor, 324 W. 83rd St., Apt. 4S, New York, NY (US) 10024-4812

( * ) Notice: Subject to any disclaimer, the term of this patent is extended or adjusted under 35 U.S.C. 154(b) by 0 days.

(21) Appl. No.: 10/923,059

(22) Filed: Aug. 19, 2004

(51) Int. Cl.
*B24B 23/00* (2006.01)

(52) U.S. Cl. ..... 451/354; 451/344; 451/356

(58) Field of Classification Search ..... 451/354, 451/344, 356, 523, 524, 456
See application file for complete search history.

(56) References Cited

U.S. PATENT DOCUMENTS

| | | | | | |
|---|---|---|---|---|---|
| 1,134,116 | A | * | 4/1915 | Ferrarini | 15/230.18 |
| 1,582,664 | A | | 4/1926 | Bennington | |
| 1,972,315 | A | | 9/1934 | Ramey | 172/36 |
| 2,546,245 | A | | 3/1951 | Weigel | 51/187 |
| 2,753,669 | A | * | 7/1956 | Larson | 451/524 |
| 3,638,362 | A | | 2/1972 | Stoll | 51/170 MT |
| 4,062,152 | A | * | 12/1977 | Mehrer | 451/344 |
| 4,071,981 | A | | 2/1978 | Champayne | 51/170 MT |
| 4,368,598 | A | | 1/1983 | Kuhlmann | 51/170 R |
| 4,680,895 | A | | 7/1987 | Roestenberg | 51/170 R |
| 4,697,389 | A | * | 10/1987 | Romine | 451/354 |
| 4,759,155 | A | | 7/1988 | Shaw | 51/392 |
| 4,765,099 | A | | 8/1988 | Tanner | 51/170 T |
| 4,779,385 | A | | 10/1988 | Reiter | 51/180 |
| 4,937,984 | A | * | 7/1990 | Taranto | 451/524 |
| 5,036,627 | A | * | 8/1991 | Walters | 451/354 |
| 5,193,313 | A | | 3/1993 | Sanchez | 51/17 R |
| 5,245,797 | A | | 9/1993 | Milkie | 51/393 |
| D342,431 | S | | 12/1993 | Swigonski | D8/70 |
| D344,003 | S | | 2/1994 | Milkie | D9/90 |
| 5,283,988 | A | | 2/1994 | Brown | 51/392 |
| 5,428,865 | A | | 7/1995 | Yarbrough | 51/353 |
| D361,487 | S | | 8/1995 | Sandow | D8/70 |
| 5,527,212 | A | | 6/1996 | Bowen | 451/456 |
| 5,540,616 | A | | 7/1996 | Thayer | 451/354 |
| 5,605,500 | A | * | 2/1997 | Matechuk | 451/456 |
| 5,624,305 | A | | 4/1997 | Brown | 451/354 |
| D392,860 | S | | 3/1998 | Brown | D8/62 |
| 5,755,616 | A | | 5/1998 | Sanichar | 451/524 |
| 5,855,505 | A | | 1/1999 | Letts | 451/523 |
| 5,964,645 | A | | 10/1999 | Jemt | 451/41 |
| 6,053,805 | A | * | 4/2000 | Sanchez | 451/456 |
| 6,503,125 | B1 | | 1/2003 | Harrington | 451/28 |
| 6,634,937 | B1 | * | 10/2003 | Edwards et al. | 451/502 |
| 6,758,731 | B2 | * | 7/2004 | Dutterer et al. | 451/357 |

* cited by examiner

*Primary Examiner*—Joseph J. Hail, III
*Assistant Examiner*—Alvin J Grant
(74) *Attorney, Agent, or Firm*—Alfred M. Walker

(57) ABSTRACT

This manual, vacuum-enabled dustless sander provides complete debris collection from both the working surface and area extending peripherally beyond the sander head while overcoming other deficiencies of prior art by projecting an abrasive screen above the sander head to form a rectangular mound which abrades while allowing debris to be drawn through itself. The projection is achieved by placing the abrasive screen atop an air permeable cushion supported by a rectangular platform made to rotate at a position of use at the intake end of a hollow shaft. Ends of the screen are inserted between the walls of two rectangular containers which rotate on the shaft and loosely embrace the platform. Rotating the shaft moves the threaded inner down the shaft into the lower container to clamp the screen in place. Vacuumed air draws all abraded debris into the sander head and through the hollow shaft to a collection canister.

20 Claims, 5 Drawing Sheets

DUSTLESS SANDER

FIELD OF THE INVENTION

The present invention relates to sanding, abrading and polishing apparatus in general. More particularly the invention relates to sanding apparatus which also vacuum cleans the debris produced by sanding and even more particularly but not exclusively to sanding apparatus used in drywall installation and repair.

BACKGROUND OF THE INVENTION

Sanding generates dust and the more vigorous the removal of material from a target of abrasion, the greater the amounts of dust generated. This dust is first airborne and can remain in the air for some time before settling. While airborne the dust is a hazard to people and requires filtering masks and other protective gear to be worn by workers and anyone else in the environment. Dust settling out of the air onto whatever surface it may drift or be blown requires laborious and time consuming effort to clean up and remove for disposal. Even if a room is sealed and surfaces protected with drop cloths or the like, the dust which falls on the workers, and the dust raised in the folding or rolling up of the drop cloths, etc., is, to some degree at the very least, lifted into the air again to settle again. This in turn requires repeated sweeping, scrubbing, and dusting of all furniture and of all surfaces both horizontal and vertical (walls, ceilings, floors) to finally clean an area.

Various attempts have been made to minimize the dust entering the general area and thus minimizing the amount of dust which will settle out of the air. These attempts have consisted of attempting to pull abraded debris and finer particulate dust by means of a vacuum stream after the dust has been generated by the abrading. In some designs of prior art grooves are cut into a rigid tool holding an abrasive screen. The grooves are cut in an attempt to channel debris to an exit after the dust's production. Some dust always escapes from the borders of the tool and the rigidity of the tool creates other problems: Suction between the rigid plate and the surface to be abraded can cause the tool to hesitate and to stick to that surface and the rigidity of the tool can contribute to gouging the surface to be abraded. Additional appliances have been offered to collect the dust which escapes from the borders of these devices, such as skirts or shrouds surrounding the tool. These devices add to the weight of the device and still fail to collect all the debris. In another offering the sides of the tool are raised to provide vacuum holes on the sides as well as the face of the device. The abrading material is held above the tool by a porous support but the channeling remains inefficient by relying again on the channeling grooves to exhaust the particulate dust and again, the weight of the device is increased.

All of the above devices are directed to sanding only planar surfaces. This restricts the use of the tool to such situations where the target surface is not only flat but of sufficient area to accommodate the dimensions of the tool. All of the above devices can be urged against a target surface at only one level of pressure, thus precluding a choice between a light sanding and hard planing away of unwanted material.

Devices of this sort all require replaceable abrasive screens. Wear and tear and general fatigue of these screens is exacerbated when the screen is pressed against the wall by the rigid face of the device holding the screen. When back and forth movement is part of the sanding process the fatigue is increased. Another factor contributing to the fatigue is the mechanism by which the screens are attached to the device. Generally, the screen is affixed to the tool by clamping the end edges of the screen between the jaws of a spring loaded metal clamp or forcing the ends of the screen into a groove cut in hard rubber, or by holding the ends of the screen in position around the face of the tool and securing it there by clamps on either side of the tool which are tightened by turning wing nuts to close the clamps. The edges of all these clamping mechanisms create blades which can tear the abrasive screen. All of these methods of fastening are also difficult and cumbersome and therefore time consuming.

These and other examples of similar prior art are described in U.S. Pat. No. 5,283,988 of Brown, U.S. Pat. No. 5,440,616 of Harrington et al., U.S. Pat. No. 4,071,981 of Champayne, U.S. Pat. No. 4,697,389 of Romine, U.S. Pat. No. 5,245,797 of Milkie, U.S. Pat. No. 5,540,616 of Thayer, U.S. Pat. No. 4,765,099 of Tanner, U.S. Pat. No. 4,937,984 of Taranto, U.S. Pat. No. 4,680,895 of Roestenberg, and U.S. Pat. No. 4,799,385 of Hulsing et al.

However, the aforementioned devices do not describe a dustless sander wherein the head of the sander, an abrasive screen supported by a malleable, air permeable cushion, projects outwardly from the body of the sander supported by a flat funnel-like platform rotating on the end of a hollow shaft, including a plurality of containers which are stacked one within the other and wherein the two containers embrace and swivel with the platform around the hollow shaft, wherein further a vacuumed stream of air draws debris not only from the working surface but also from the peripherally surrounding area before the debris escapes into the atmosphere.

OBJECTS OF THE INVENTION

It is an object of the present invention to provide a manual, vacuum-enabled, dustless sander and polisher designed primarily, but not exclusively, for working on plaster, joint compound or similar substances used in drywall installation and repair.

It is another object of the present invention to provide a sander capable of virtually total cleaning capability of abraded debris, which capability is realized at any angle of vertical or horizontal use, and above or below the person using the device i.e., on floors, walls or ceilings.

A further object of the device is to minimize the weight of the device, making general use, and especially overhead use, less tiring to the worker.

Another object is to provide a device which glides more easily over working surfaces than previous devices where a gripping effect, caused by suction between the sander face and the working surface, causes those devices to stall or stick to the working surface.

Yet another object is to reduce the fatigue on the abrasive screen by avoiding the grinding of the abrasive screen between a hard sander face and the working surface.

Another object is to provide a sander effective not only on flat surfaces but also on curved surfaces, surfaces in or on corners, and on rounded surfaces.

Yet another object is greater ease of attaching and detaching the disposable abrasive screen common to these sanding devices and known to those familiar with the art.

Another and related object is reduction of fatigue to abrasive screen caused by clamping arrangements of prior art.

A still further object is to provide a sander which allows for varying degrees of pressure of the sanding screen against the working surface with no loss of abrading effectiveness or vacuum cleaning power.

SUMMARY OF THE INVENTION

These objects and others apparent to those skilled in the art are achieved by projecting the head of the sander, an abrasive screen supported by a malleable, air permeable cushion, above the body of the sander. The cushion is supported by a flat funnel-like platform which includes a bored hub, wherein the bored hub of the flat funnel-like platform rotates in a position of use around a flanged pipe inserted into the open end of a hollow shaft. The screen is held in place above the cushion and over the platform by inserting the end edges of the screen into the space between the walls of two containers which loosely embrace the platform. The containers are stacked one within the other and rest easily and loosely within each other. The containers swivel with the platform around the hollow shaft. These containers constitute the body of the sander by which the sander, in one embodiment, may be held. The inner of the containers is threaded at its point of rotation on the hollow shaft. The outer of the containers is fixed at one axis on the hollow shaft. Thus, turning the hollow shaft drives the inner container downward into the outer container, thereby trapping and locking the inserted end edges of the screen in place between the walls of the containers. A vacuumed stream of air draws debris not only from the working surface but also from the peripherally surrounding area before the debris escapes into the atmosphere. The debris is captured and drawn by vacuumed air and pulled through the abrasive screen, the supporting cushion, the funnel platform, the hollow shaft and then through the vacuum line attached to the hollow shaft and finally through the vacuum line to a shop vacuum cleaner or conventional vacuum cleaner capable of fine particulate collection.

In a preferred embodiment, the sander includes a shaft having a distal end and an opposite proximal end. A lower container is disposed within the housing, with the lower container having a plurality of walls and a base, and the lower container base having a hole therein. An upper container is disposed within the lower container, with the upper container having a plurality of walls and a base, and the upper container base having a hole therein, so that the upper container hole is substantially aligned with the lower container hole. A rotatable platform is located within the upper container and an air-permeable malleable cushion contacts the platform and is located within the second container. To accomplish abrasion, an air-permeable abrasive screen is temporarily secured between the upper container and the lower container.

A portion of the shaft is substantially perpendicular to the lower container base.

The walls of the lower container are preferably tapered at an angle greater than ninety degrees with respect to the lower container base; and the walls of the upper container are tapered such that the walls of the upper container are substantially parallel with the walls of the lower container. Additionally, the shaft is substantially aligned with the upper container hole and the lower container hole.

The platform further includes a hole substantially aligned with the shaft, the upper container hole, and the lower container hole wherein a flanged pipe resides in the platform hole. The shaft has a threaded portion and the upper container has a hub having threads corresponding with the threaded portion of the shaft. A flanged support on the shaft separates the threaded portion of the shaft from a remainder of the shaft, so that the flanged pipe and the flanged support delineate a range of lateral movement of the upper container. A lower container flange is secured to the shaft, so that the lower container flange limits lateral movement of the lower container. Preferably an adhesive such as glue secures the lower container flange to the shaft. A fastener, such as a set-screw, secures the lower container flange to the shaft.

A first portion of the lower container flange and a second portion of the lower container flange are interlocked to secure the lower container flange to the shaft. Furthermore, a base of the platform is tapered towards the platform hole. Also, a portion of the air-permeable abrasive resilient screen is secured between the walls of the upper container and the of walls of the lower container.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE DRAWINGS

Figure 1:
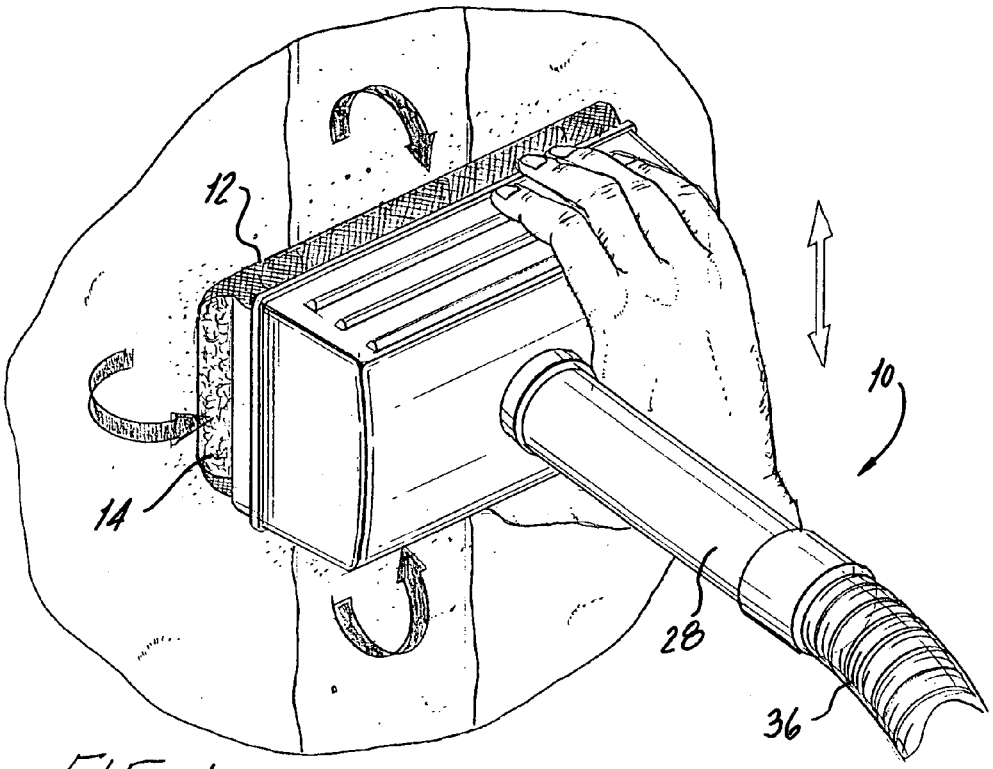
FIG. 1 is an overall perspective view of a preferred embodiment of the invention in use with arrows illustrating the vacuum stream drawing debris into the sander.

This invention is a manual, vacuum-enabled dustless sander, designated generally by reference numeral 10, which by means of vacuumed air draws all the debris created by sanding into the head of the sander and then through the central column 28 of the sander 10 and then via the vacuum hose 36 into the collection canister of a shop or standard vacuum cleaner.

FIG. 1 illustrates a preferred embodiment of the dustless sander 10 in use on a working surface with arrows indicating the inward flow of air carrying debris into the sander 10.

Figure 2:
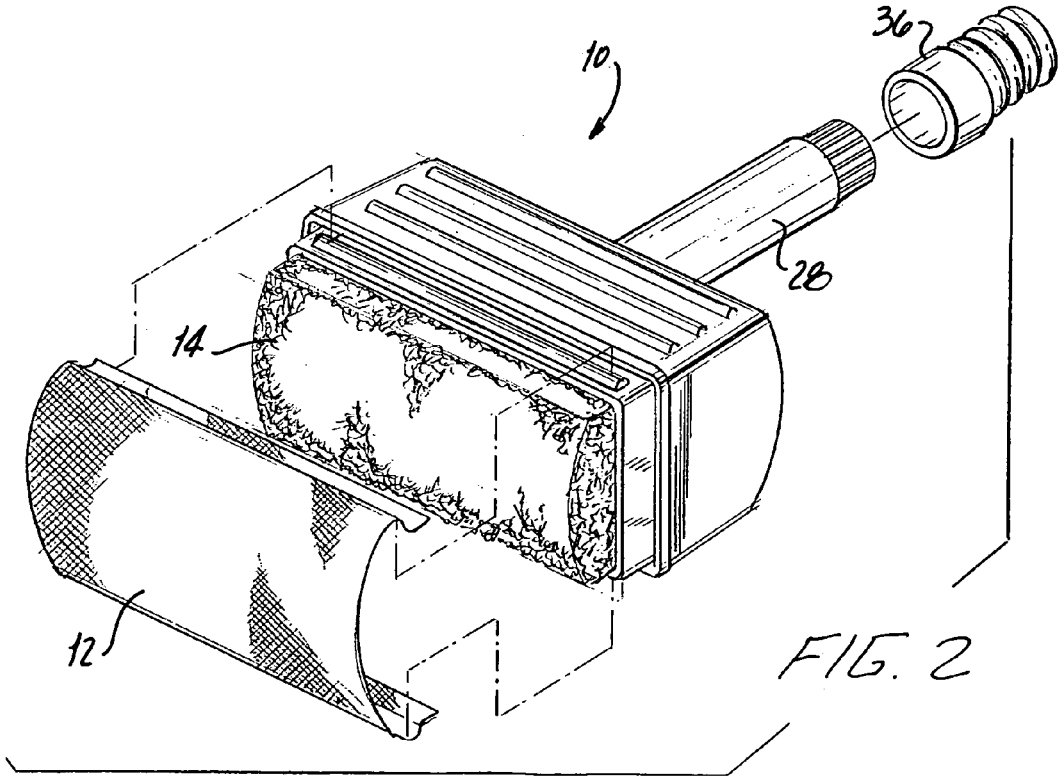
FIG. 2 is an overall perspective view with the sanding screen detached from the sander and the sander detached from the vacuum line.

FIG. 2. illustrates the dustless sander with the abrasive screen 12 detached and shows the path for attachment of the abrasive screen 12 into the body of the sander 10. FIG. 2. also shows the sander 10 detached from the vacuum line 36.

Figure 3:
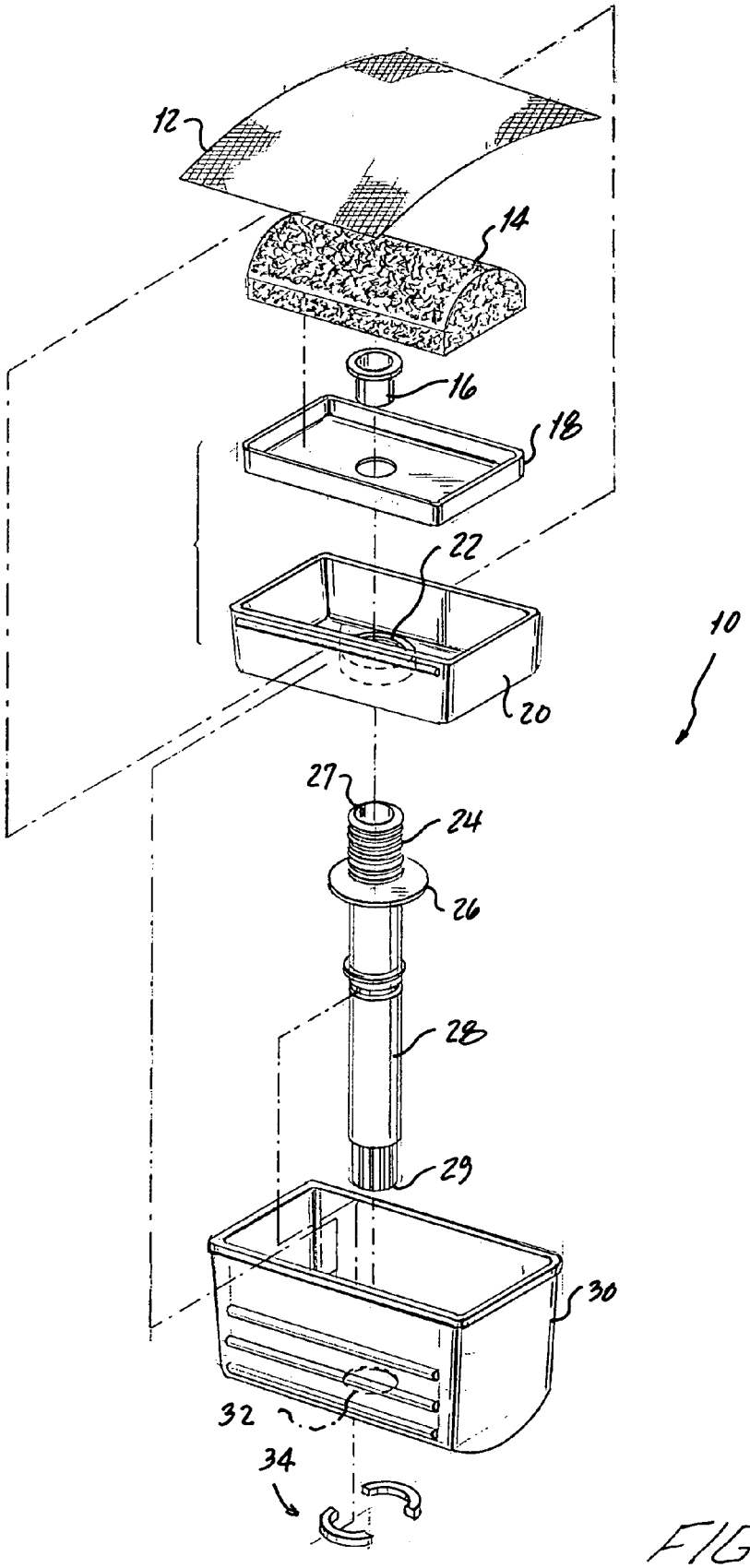
FIG. 3 is an exploded view of the sander.

Referring to FIG. 3, wherein an exploded view of the sander 10 illustrates the disposition of sander components on and around the central column 28. In this embodiment the material of all the parts is plastic. In a heavy-duty embodiment, steel or other metals, or combinations of materials may be preferred. In varying embodiments still other different materials may be preferred, even paper composites, such as cardboard, may be indicated for some lighter duty applications.

The construction of the sander is organized on the central column 28, a hollow round shaft which provides support for the components on its outer surface and a channel for vacuumed air through its inner surface. The central column 28 is threaded at one end. The threaded end will be considered the upper end of the column 28 and the upper end of the sander 10. Two containers 20 and 30 rotate on the column 28. Both containers have bases of similar size and both have walls which taper outward in the upward direction so that one may rest within the other. The upper container 20 rotates on the column 28 and travels a certain length of the central column 28 by means of thread 24 cut into the external surface of the central column 28 and thread cut into the internal surface of a bored hub 22 in the base of the upper container 20. The thread 24 on the column is of a distance only great enough to move the upper container 20 from its open position downward into the lower container 30 to its closed position where the walls of the upper container 20 are pulled firmly against the walls of the lower container 30. A flange 26 at the bottom of the threaded portion 24 of the central column 28 prevents the upper container 20 from pressing any more than as above described into the lower container 30. The flange also serves as a barrier to prevent the lower container 30 from traveling along the threaded portion 24 of the column 28. The lower container 30 rotates freely on the column 28 held to a fixed path of rotation on the column 28 between the flange 26 at the bottom of the threaded portion 24 of the column 28 and the flange 34 attached to the column 28 at a position on the column 28 beneath the lower container 30. The flange 34 may be attached to the column 28 by means of a set screw or snap-on fitting or glue.

A platform 18 with four walls and a hole in its base performs as a funnel and is made to rotate on the top of the column 28, by means of a flanged pipe 16, the narrow length of which passes through the hole in the platform 18 and into opening 27 of the top end of the column 28. The flanged pipe 16 is snugly held at a fixed position inside the column 28 by friction. The platform 18 rotates freely around the length of the flanged pipe 16 between the top of the column 28 and the flange of the flanged pipe 16.

Figure 4:
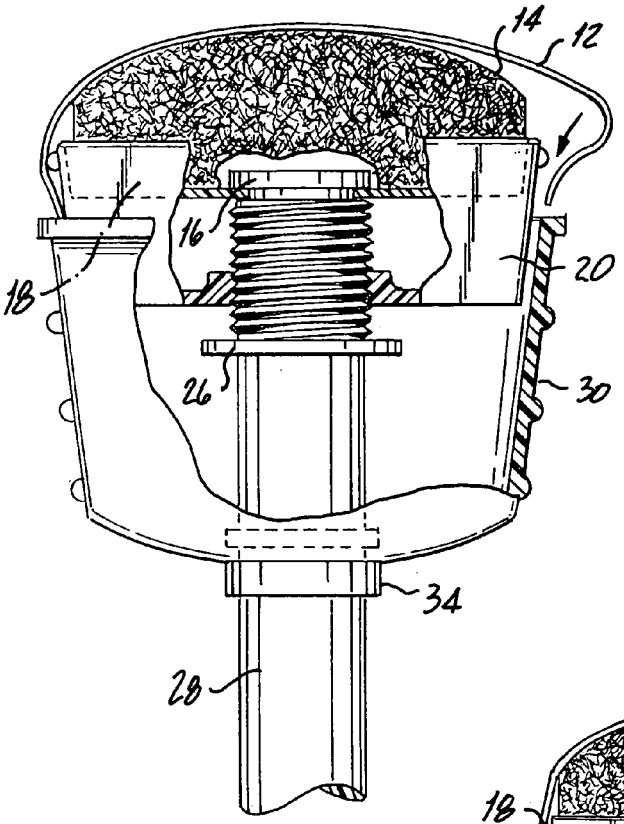
FIG. 4 is a partially cut away side view of sander with abrasive screen detached at arrow.

As illustrated in FIG. 4, a cutaway view of the head of the sander, the rotating platform 18 supports a resilient, air permeable cushion 14. A replaceable abrasive screen 12 is held in place above the cushion.

The cushion 14 is composed of loosely woven non-adhering plastic yarn-like filaments and constructed in a manner which creates resiliency and unimpeded passage of air through the cushion 14. The cushion 14 is similar to plastic scrubbing pads used for cleaning cooking pots and pans. The cushion 14 is of sufficient size so that the top of the cushion 14 rises above the top of the upper container 20. Resiliency of the cushion permits varying degrees of pressure to be exerted against the abrasive screen 12 and thus to abrading. As pressure urges the sanding head against a working surface, the cushion 14 and the abrasive screen 12 conform, by degree of pressure applied, to the shape of the platform but at its most dense compression the structure of the cushion 14 still allows unhindered passage of air through itself.

Figure 7:
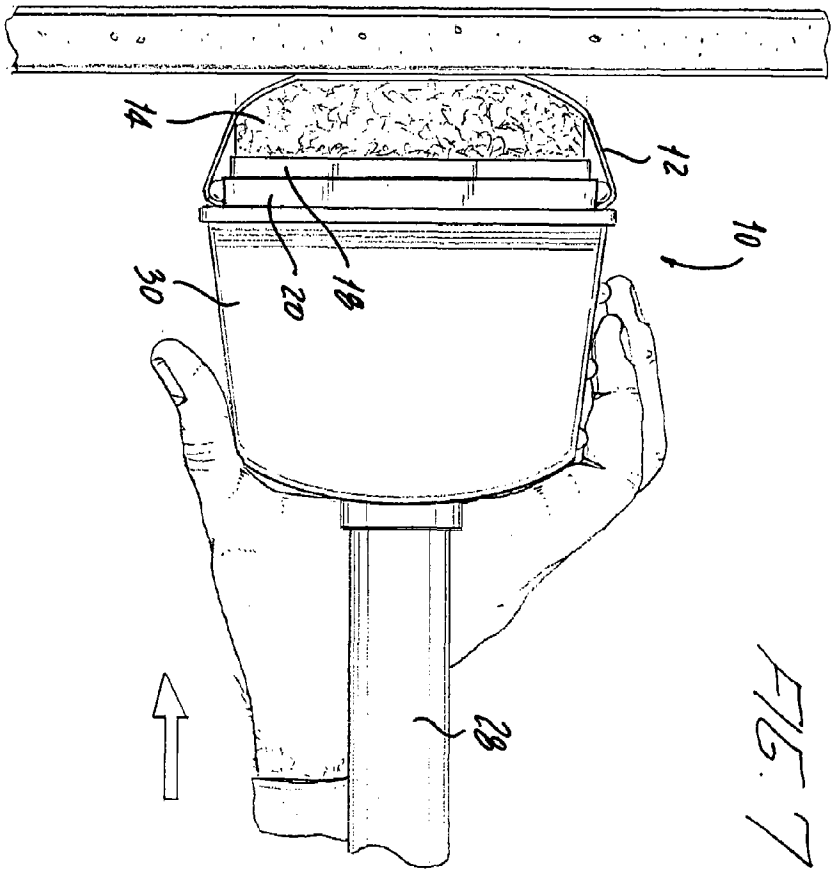
FIG. 7 is a side view of device at minimal compression against target surface.
Figure 8:
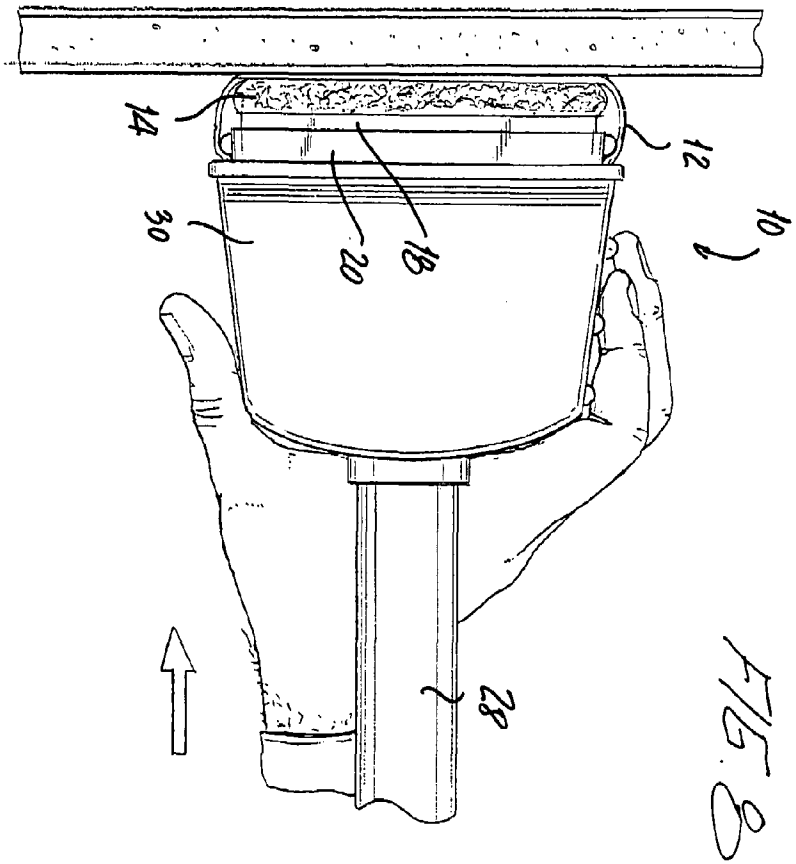
FIG. 8 is a side view of device at greatest compression against target surface.

FIG. 7 and FIG. 8 illustrate the behavior of the sander head under varying degrees of pressure. Further, the malleability of the sander head, the cushion and the abrasive screen, allows the sander head to shape itself to the working surface: planar, curved or cornered, while maintaining air flow through itself and thereby maintains complete cleaning capability of differing working surfaces.

The cushion 14 may be affixed to the platform 18 by adhesive. The attachment is executed in a manner which does not impede passage of air through the cushion 14 to the hole in the center of the platform 18.

The various components of the sander 10 are assembled by turning the upper end of the central column 28 into the thread of the upper container 20, then sliding the lower container 30 over the upper container 20 so that the lower container 30 rests loosely outside the upper container 20. The flange 34 may then be affixed to the central column 28 below the lower container 30 so that both containers 20 and 30, resting within each other, easily rotate on the central column 28. The rotating platform 18 is attached to the top of the central column 28 by means of the flanged pipe 16. The platform rests just within the borders of the upper container so that the platform 18 rotates with and within the two containers. The two containers constitute the body and handle of the sander. Placing the abrasive screen 12 above the cushion 14 and then inserting the end edges of the screen 14 into the gap between the walls of the upper container 20 and lower container 30, and then turning the central column 28, thereby driving the upper container 20, by means of threading 24, down and into the lower container 30, locks the screen 14 in place.

Figure 5:
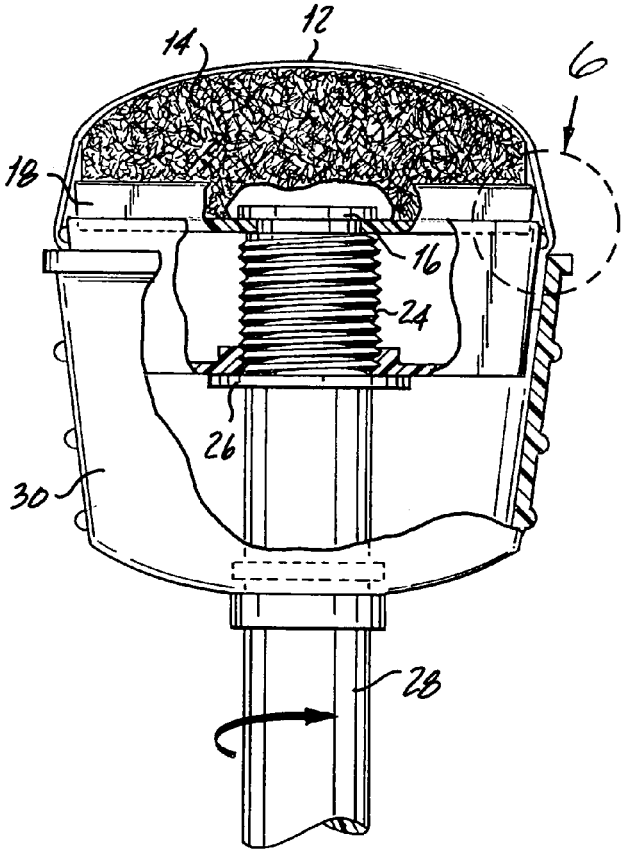
FIG. 5 is another partially cut away side view of sander with abrasive screen attached and locked in place.

The locking of the abrasive screen 12 is illustrated more particularly in FIG. 4 where the arrow indicates the point of insertion of the screen into the gap between the walls of the two containers 20 and 30 and in FIG. 5 where the circle marked 6 shows the screen 12 locked between the walls of the two containers 20 and 30.

Figure 6:
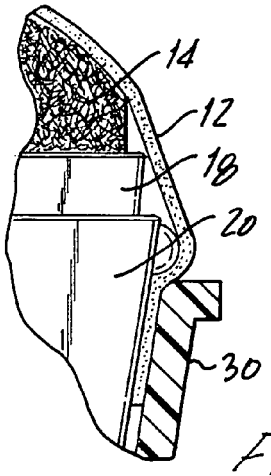
FIG. 6 is a cut away side view of detail marked 6 in FIG. 5.

FIG. 6 is a detail of FIG. 5 showing the screen trapped in place.

To operate the sander, the vacuum line 36 is attached to the lower end of the central column 28. A stream of air drawn through the vacuum line pulls debris abraded by the sander 10 through the sander 10 and through the vacuum line 36 to a vacuum cleaner.

Figure 9:
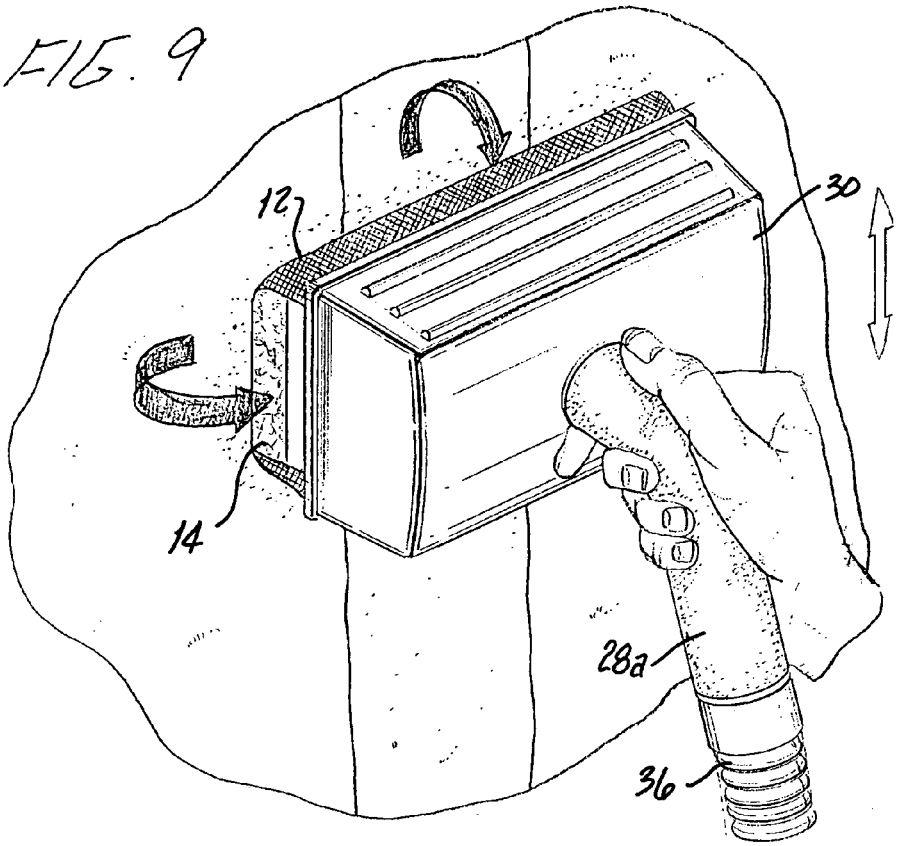
FIG. 9 is a top view of the sander in use with arrows indicating path of debris into the sander; and, FIG. 10 is an exploded view of a sander kit.

FIG. 9 shows an optional ergonomically shaped handle **28*a* for the vacuum line 36. Handle 28*a*** may be curved in shape, and may have an easily gripped elastomeric or other textural outer covering.

Figure 10:
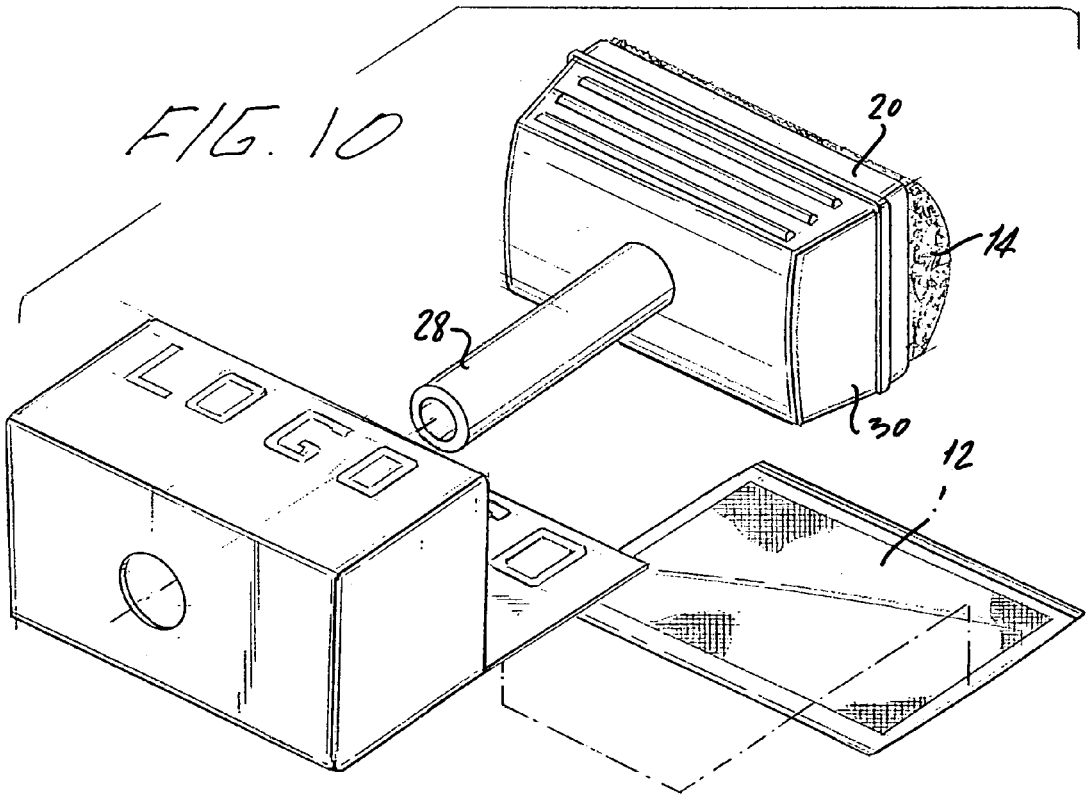

FIG. 10 shows a kit for retail display or consumer storage of the components of the present invention. For example, central column 28, having containers 20 and 30 attached thereto, can be stored within the display box, along with fresh sand paper sheets 12.

As will be apparent to those familiar with the art this invention has been described in terms of one embodiment. Variations may be incorporated or added onto the basic idea without departing from the spirit and/or ambit of the invention.

I claim:

1. A sander comprising a central column providing a channel for vacuuming air through its interior surface and said central column supporting a head of a sander and a body of said sander on an external surface of said central column, and, said sander head comprising a replaceable air-permeable abrasive resilient screen supported by an air-permeable malleable cushion, which said cushion is in turn supported by a funnel-like platform, which said platform rides on said central column and a sander body comprising:

a first container which rotates on and moves up and down said central column and a second container which rotates on said central column at a fixed path of rotation while said second container loosely embraces said first container with enough space between respective walls of said two containers to permit the insertion of respective end edges of said abrasive screen and a means of moving said first container downward to sit in said second container so that said end edges of said abrasive screen may be trapped and looked in place between said walls of said two containers and moved upward to release said abrasive screen.

2. The sander as in claim 1 wherein said abrasive screen is clamped between said walls of said two containers for ease of attachment and removal of said abrasive screen.

3. The sander as in claim 1 wherein said air permeable air cushion supports said abrasive screen above and beyond respective borders of a head of said sander, thereby allowing total cleaning of the adjacent area being cleaned by said sanding device sander.

4. The sander as in claim 1 wherein said malleable surface of said sander head engages and abrades varying shaped surfaces.

5. The sander as in claim 1 wherein said sanding head conforms to a respective shape of said platform under pressure against a working surface.

6. The sander as in claim 1 wherein a malleable backing reduces user fatigue caused by grinding of said abrasive screen against a working surface and by eliminating sharp edged clamping of said abrasive screen.

7. A sander comprising:

a shaft having a distal end and a proximal end;

a lower container having a plurality of walls and a base, and said lower container base having a hole therein wherein said lower container is positioned on said distal end of said shaft through said lower container hole;

an upper container disposed within said lower container, said upper container having a plurality of walls and a base, and said upper container base having a hole therein, wherein said upper container hole is substantially aligned with said lower container hole;

a rotatable platform disposed within said upper container;

an air-permeable malleable cushion contacting said platform and disposed within said second container; and an air-permeable abrasive resilient screen temporarily secured between said upper container and said lower container.

8. The sander according to claim 7, wherein a portion of said shaft is substantially perpendicular to said lower container base.

9. The sander according to claim 7, wherein said plurality of walls of said lower container are tapered at an angle greater than ninety degrees with respect to said lower container base; and said plurality of walls of said upper container are tapered such that said plurality of walls of said upper container are substantially parallel with said plurality of walls of said lower container.

10. The sander according to claim 7, wherein said shaft is substantially aligned with at least one of said upper container hole and said lower container hole.

11. The sander according to claim 7, wherein said platform further comprises a hole substantially aligned with at least one of said shaft, said upper container hole, and said lower container hole.

12. The sander according to claim 11, further comprising a flanged pipe residing in said platform hole.

13. The sander according to claim 7, wherein said shaft has a threaded portion and said upper container has a hub having threads corresponding with said threaded portion of said shaft.

14. The sander according to claim 13, further comprising a flanged support on said shaft which separates said threaded portion of said shaft from a remainder of said shaft, wherein said flanged pipe and said flanged support delineate a range of lateral movement of said upper container.

15. The sander according to claim 14, further comprising a lower container flange secured to said shaft, wherein lower container flange limits lateral movement of said lower container.

16. The sander according to claim 15, wherein glue secures said lower container flange to said shaft.

17. The sander according to claim 15, wherein a set-screw secures said lower container flange to said shaft.

18. The sander according to claim 15, wherein a first portion of said lower container flange and a second portion of said lower container flange are interlocked to secure said lower container flange to said shaft.

19. The sander according to claim 11, wherein a base of said platform is tapered towards said platform hole.

20. The sander according to claim 7, wherein a portion of said air-permeable abrasive resilient screen is secured between said plurality of walls of said upper container and said plurality of walls of said lower container.

* * * * *